US006575844B1

(12) United States Patent
Gray

(10) Patent No.: US 6,575,844 B1
(45) Date of Patent: Jun. 10, 2003

(54) GOLF STANCE AND MOVEMENT TRAINING DEVICE

(75) Inventor: Richard R. Gray, Granite City, IL (US)

(73) Assignee: Richard R. Gray, Jr., Granite City, IL (US)

( * ) Notice: Subject to any disclaimer, the term of this patent is extended or adjusted under 35 U.S.C. 154(b) by 0 days.

(21) Appl. No.: 09/792,814

(22) Filed: Feb. 24, 2001

(51) Int. Cl.[7] ..... A63B 69/36
(52) U.S. Cl. ..... 473/277; 473/273; 473/452
(58) Field of Search ..... 473/277, 271, 473/273, 218, 272, 452

(56) References Cited

U.S. PATENT DOCUMENTS

| | | | | |
|---|---|---|---|---|
| 1,936,143 A | | 11/1933 | Shea | 273/35 |
| 3,623,733 A | | 11/1971 | Cavanaugh | 273/183 |
| 4,659,084 A | | 4/1987 | Vuick | 273/183 |
| 4,758,000 A | | 7/1988 | Cox | 273/190 |
| 4,895,372 A | | 1/1990 | Muller | 273/183 |
| 5,039,105 A | | 8/1991 | Ro | 273/183 |
| 5,050,885 A | | 9/1991 | Ballard et al. | 273/183 |
| 5,203,569 A | | 4/1993 | Rilling | 273/187 |
| 5,288,074 A | * | 2/1994 | Scheurer | 473/277 |
| 5,303,926 A | | 4/1994 | Owens et al. | 273/186 |
| 5,830,079 A | * | 11/1998 | Hudson | 473/272 |
| 5,984,797 A | | 11/1999 | Kessler et al. | 473/216 |

* cited by examiner

*Primary Examiner*—Paul T. Sewell
*Assistant Examiner*—M. Chambers

(57) ABSTRACT

The training device has a u shaped base comprised of a adjustable toe board strip, which is used to promote balance on the balls of the feet and keep the training device from tipping over. The adjustable knee brace, attached to one of three vertical mast, is positioned on the side of the body producing the back swing. The knee brace, contacts the side and back of knee, supporting the proper angle of the knee while controlling lateral and vertical movement. Adjustable upper support assembly, telescoping lateral bar, positions golfer in center of device. Telescoping horizontal back bar in conjunction with angled side bar, contact the lower lumbar of back and hips on side of body producing back swing, effectively controlling lateral and vertical movement. A angled padded vertical bar, positioned in the centered of the back promotes the proper spine angle and allows golfer to stay centered by rotating the upper body around the bar as axis of spine and clearing in the follow thru swing.

7 Claims, 6 Drawing Sheets

GOLF STANCE AND MOVEMENT TRAINING DEVICE

CROSS-REFERENCE TO RELATED APPLICATIONS

Not applicable.

BACKGROUND-FIELD OF INVENTION

An invention relating to a golf-training device, specifically designed for stance, movement and swing axis.

BACKGROUND-DESCRIPTION OF PRIOR ART

Anyone who has played golf knows the stance or setup position is the foundation of the swing. Any deviation of setup position or loss of balance during the swing will cause a poor shot. There are other factors that affect the golf swing too. For example, lateral, vertical movement, rotation of upper body, swing plane and grip. At present stance related golf training aids, do little to promote a consistent and proper stance. A simple, easy to use training device was needed that would bend the knees and back to form the proper angles for stance, promote balance, control lateral, vertical movement, aid in the rotation of upper body around the axis of the spine, and allow you to maintain that position throughout the golf swing. Through certain repetitive motions in the training device, utilizing specific muscles, it encourages muscle memory. This repetitive motion helps a golfer develop a repeatable golf swing on or off the golf course. Other products have tried to achieve this, but fall short of completeness. The present invention has all the elements necessary to fulfill this need.

U.S. Pat. No. 583,007, relies on a back bar, hip bar and knee brace mounted on a frame to promote a proper stance and control movement. Device shows no guides that would indicate how a proper stance could be achieved. A device was needed that would form the correct angles of the spine and knee in the stance, utilizing a vertical axis bar and knee brace. The hip bar attached to the buttocks bar on said device, does not produce the controlled movement as well as a bar horizontally across lower back and angled down to hips. The kneepad in said patent, limits itself to lateral movement, which is not as effective as a knee brace that will control lateral or vertical movement and position the knee to the proper angle for stance.

U.S. Pat. No. 4,758,000, refers to a elevated crank support passing thru the upper body, neck and head for pivotal movement of a golf swing axis. Device uses guides for shoulders and head to intersect with pivotal axis, to control swing axis. Device has constraints that are too confining and restrict free flowing movement of golfer. A less restrictive device was needed.

Present invention promotes swing axis around an angled padded vertical axis bar. Positioned in center of back as axis of spine, said allows free rotation of torso. Then clearing of said in the follow thru swing.

U.S. Pat. No. 5,050,885, refers to leg movement limiting device attached to base, assemblies on a saddle attached to golfers hips to promote hip rotation and a vest worn by golfer to position shoulders. Device uses confining and restrictive guides to control axis of swing and lateral movement. A simple device was needed that would provide an angled axis for the spine to rotate around, control lateral and vertical movement, in a less confined and restrictive manner.

U.S. Pat. No. 530,326, refers to an adjustable rod on a guidepost, that when adjusted to certain positions, will promote, proper body positions and swing motions. Device, can only work on one aspect of the game at a time. Making it confusing, to try to put all the components of the stance and swing together. A simple device was needed that could provide all the necessary elements needed to position the body in a golf stance and control lateral and vertical movement in a fixed position.

SUMMARY

In accordance with the present invention a golf-training device comprised of a base, three vertical mast, knee brace and upper guide assembly. Guides on said invention positions golfers back and knee at proper angles in stance, promotes balance, controls lateral, vertical movement and keeps golfer centered on axis of spine throughout swing. The primary objects of the invention are to instruct proper stance and proper movement of body in relation to golf swing.

OBJECTS AND ADVANTAGES

Accordingly, besides the objects and advantages of the golf training device described in the above patent, several objects and advantages of the present invention are:

(a.) to provide an object that will position the knees and back to the proper angles in the stance (b.) to provide an object that will control lateral and vertical movement (c.) to provide an object for staying centered by rotating around the axis of your spine (d.) to provide an object that will promote a balanced swing (e.) to provide an object that can be adapted for use by right or left handed golfers The present invention satisfies the above objects by providing a golf setup and movement training device that provide support and guides, to achieve the objects described above. Prior to present invention, no simple, easy to use device had been made, to solve the problem of positioning the spine and knee to the proper angles in the stance or to maintaining that position during the swing. No simple and easy to use device had been made, prior to present invention, to help a golfer stay centered by rotating the upper body around the angled axis of his spine. No simple, easy to use device has been made placing golfer on balls of feet for a balanced swing. The present invention is constructed of PVC pipe, PVC fittings, joined by PVC glue, oak wood strip, attached to device with bolts and wing nuts.

The bottom section of the trainer has a toeboard, which is used to promote balance on the balls of the feet and keep the trainer from tipping over. The knee brace is attached to a vertical mast, positioned on the side of the body producing the back swing. The knee brace contacts the side and back of knee supporting the proper angle for the knee while controlling lateral and vertical movement.

The upper support assembly, horizontal back bar in conjunction with angled side bar, engages the side of the body from the lower lumbar of back to the hips, effectively controlling lateral and vertical movement of the upper body. A vertical back bar angled at 34 degrees, positioned in the center of the back promotes the proper spine angle and allows you to stay centered by rotating the upper body around said as axis of spine. Further objects and advantages are to provide a golf training aid which is easy to use, portable and weather resistant. Even further objects and advantages of my invention will become apparent from a consideration of the drawings and ensuing description

DESCRIPTION OF DRAWINGS

In the drawings closely related figures have the same number but different alphabetic suffixes.

Figure 1:
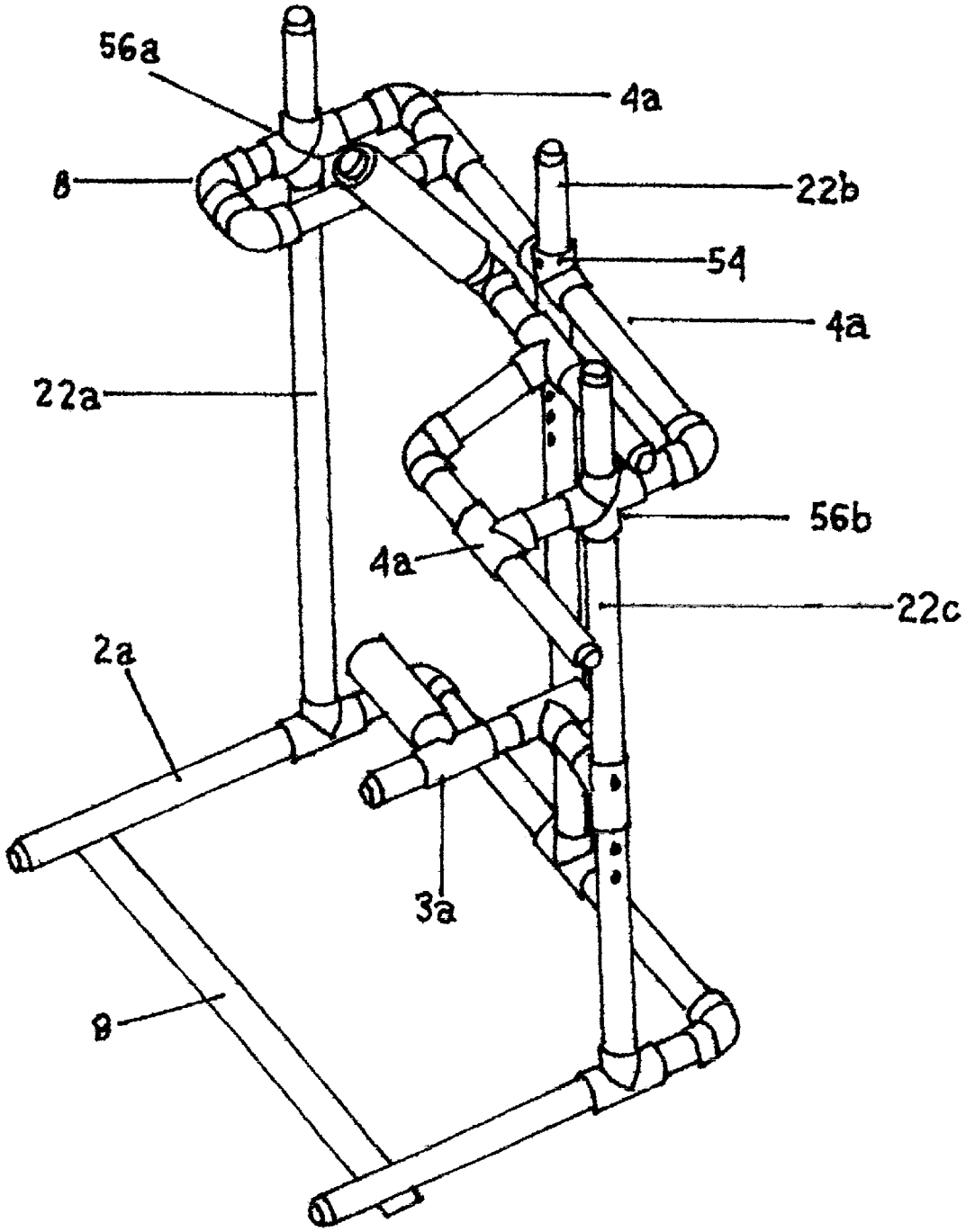
FIG. 1 shows a perspective view of the golf-training device

REFERENCE NUMERALS IN DRAWINGS 2a. base
3a. knee brace
4a. upper support assembly
7. angled side bar
8 detachable spacer bar
9. toeboard strip
10. a. bolt and wing nut
b. bolt and wing nut
12. a. base adjustable toeboard post
b. base adjustable toeboard post
13. a. base 90 degree fitting
b. base 90 degree fitting
14. a. base T fitting
b. base T fitting
c. base T fitting
16. a. base straight pipe
b. base straight pipe
c. base straight pipe
d. base straight pipe
18 a. base end caps
b. base end caps
20. a. base securing pin
b. base securing pin
22. a. vertical mast
b. vertical mast
c. vertical mast
23. a. mast end caps
b. mast end caps
c. mast end caps
24. a. knee brace adjustable T joint
b. knee brace adjustable T joint
26. a. knee brace straight pipe
28. knee brace telescoping post
30. knee brace T joint
32. knee brace horizontal bar
33. knee brace horizontal bar foam pad
34. knee brace lateral bar
36. a. knee brace plastic end cap
b. knee brace plastic end cap
38. a. knee brace securing pin
b. knee brace securing pin
40. telescoping lateral bar
42. a. top securing pin
b. top securing pin
c. top securing pin
44. a. top adjustable T fitting
b. top adjustable T fitting
46. a. top straight pipe
b. top straight pipe
c. top straight pipe
d. top straight pipe
e. top straight pipe
f. top straight pipe
g. top straight pipe
h. top straight pipe
i. top straight pipe
j. top straight pipe
48. telescoping back bar
50. vertical axis bar
51. vertical axis bar foam pad -continued 52. a. top 90 degree fitting
b. top 90 degree fitting
c. top 90 degree fitting
d. top 90 degree fitting
e. top 90 degree fitting
f. top 90 degree fitting
54. adjustable 4 way fitting
56. a. sliding 4 way fitting
b. sliding 4 way fitting
58. T fitting
62. a. top plastic end cap
b. top plastic end cap
c. top plastic end cap
d. top plastic end cap
64. golfer
66. golf club

DESCRIPTION OF THE DRAWINGS

Figure 2:
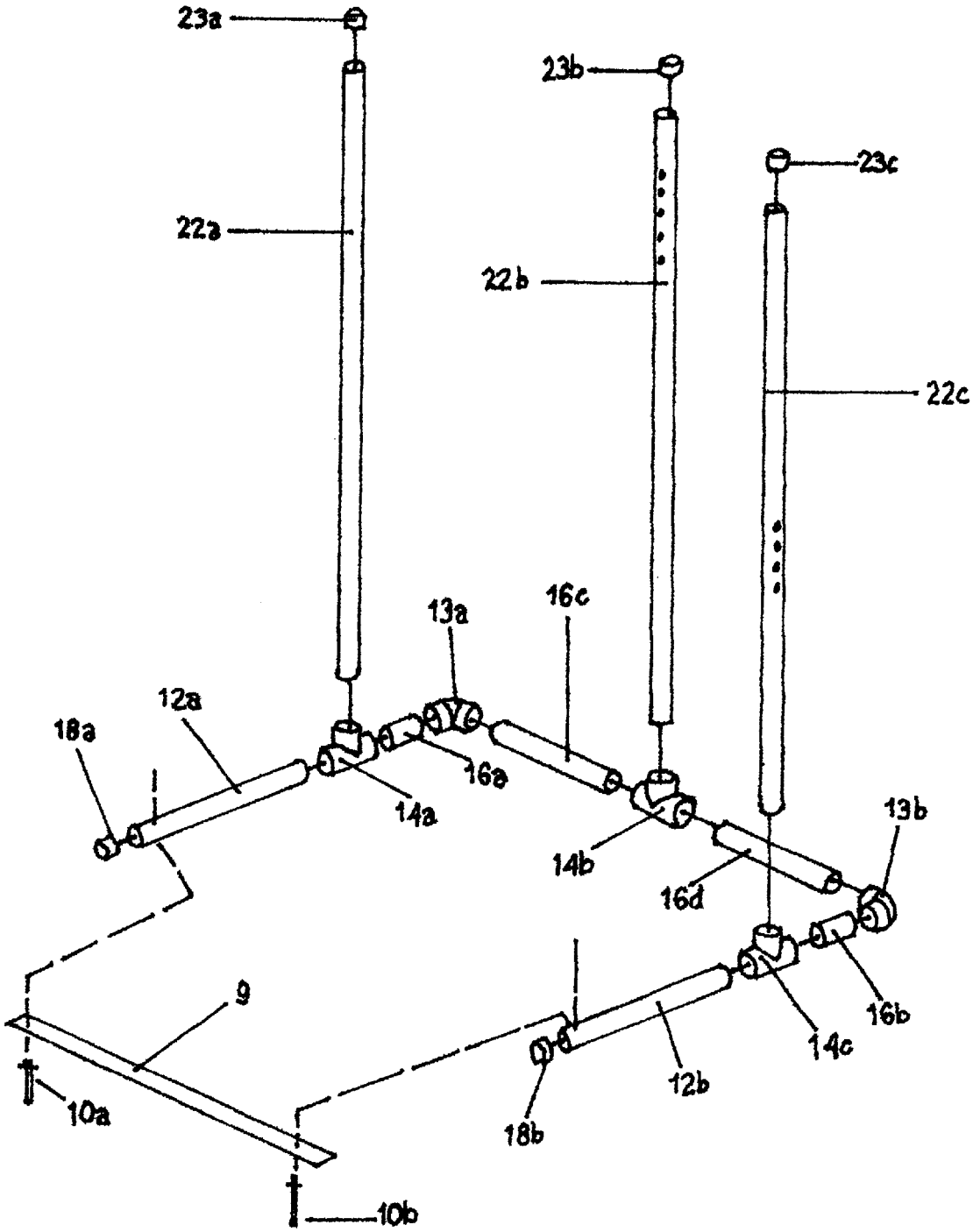
FIG. 2 shows a base

Referring now to FIG. 1 there is illustrated a prospective view of applicant's device. As shown it comprises a U shaped base 2*a*, a toeboard strip 9, connects both sides of said section 2*a*, individual components of said 2*a* are shown in detail in FIG. 2. Said 2*a*, receives three vertical mast 22*a*, 22*b*, 22*c*, as shown in FIG. 1 and FIG. 2. Attached to said 22*c* is knee brace 3*a*, as shown in FIG. 1, detailed individual components of said 3*a* in FIG. 3. The upper support assembly 4*a*, is slidably attached to said 22*a*, 22*b*, 22*c*, thru sliding 4 way fittings 56*a*, 56*b* and adjustable 4 way fitting 54 as shown in FIG. 1. Individual components of said 4*a* are shown in FIG. 4.

Figure 5:
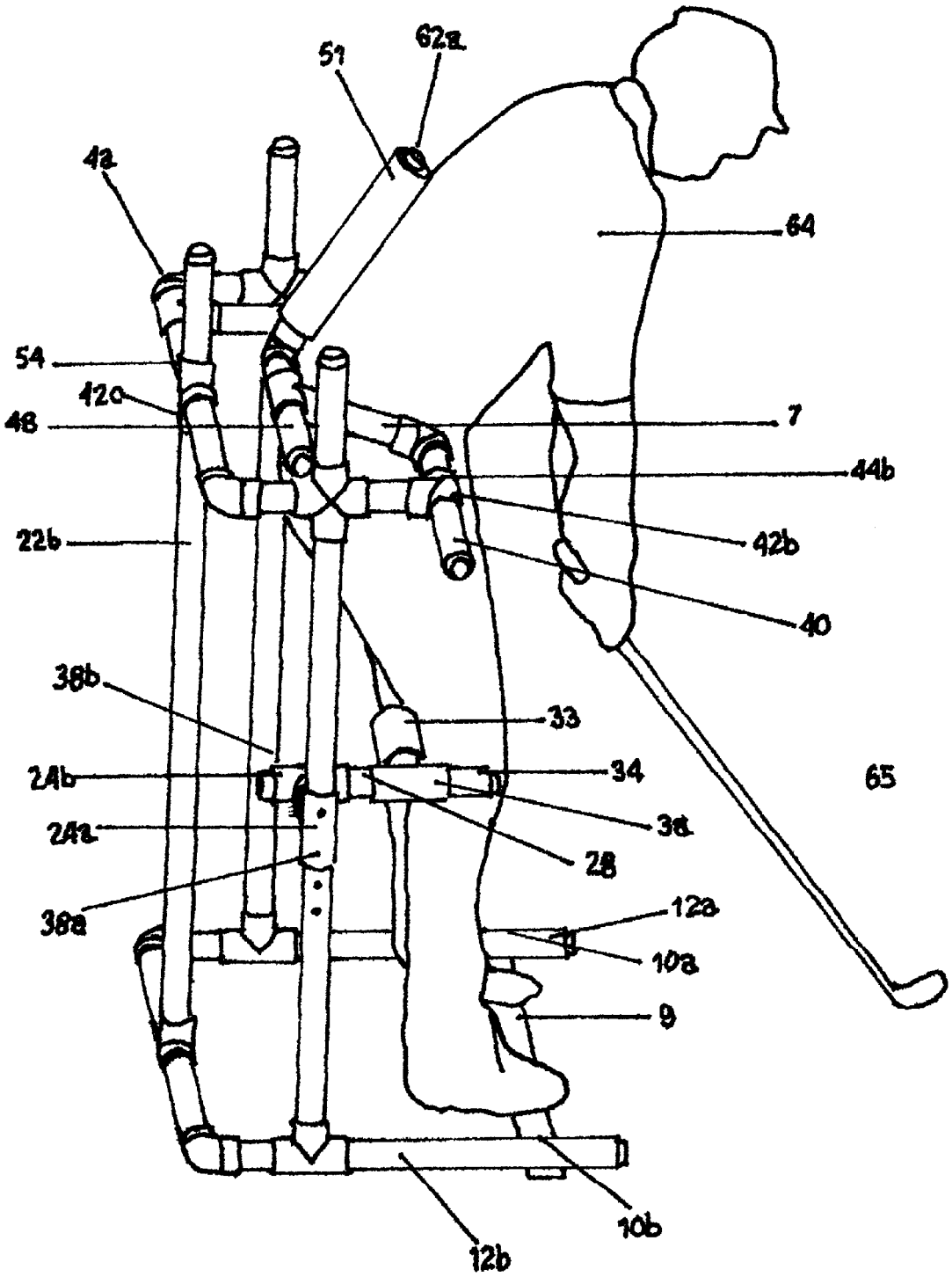
FIG. 5 shows a side view with golfer

Turning now to FIG. 2, there is shown exploded view of said 2*a*, including 22*a*, 22*b* and 22*c*. Said 2*a* is comprised of said 9, attached to adjustable toeboard post 12*a*, 12*b*, by bolt and wing-nut 10*a*, 10*b*. Inserted into open ends of said 12*a*, 12*b* are plastic base end caps 18*a*, 18*b*. Said 12*a*, 12*b* are attached to base T fitting 14*a*, 14*c*. Opposite side of said 14*a*, 14*c* are predetermined base straight pipe 16*a* and 16*b*, connected to end of said 16*a*, 16*b* is base 90 degree fitting 13*a* and 13*b*. Opposite side of said 13*a*, 13*b* are predetermined base straight pipe 16*c* and 16*d*, connected to ends of said 16*c*, 16*d* is base T fitting 14*b*. Said 14*a*, 14*b*, 14*c*, receives said 22*a*, 22*b*, 22*c* as shown. Inserted into top of said 22*a*, 22*b*, 22*c* are mast end caps 23*a*, 23*b*, 23*c* as shown in FIG. 2. FIG. 5 shows golfer 64, placing toes of feet on said 9, positioning said 64 on balls of feet for balance and aligning toes straight to target line. FIG. 5 shows said 64, using said 9, to stabilize device and as guide for hands during swing.

Figure 3:
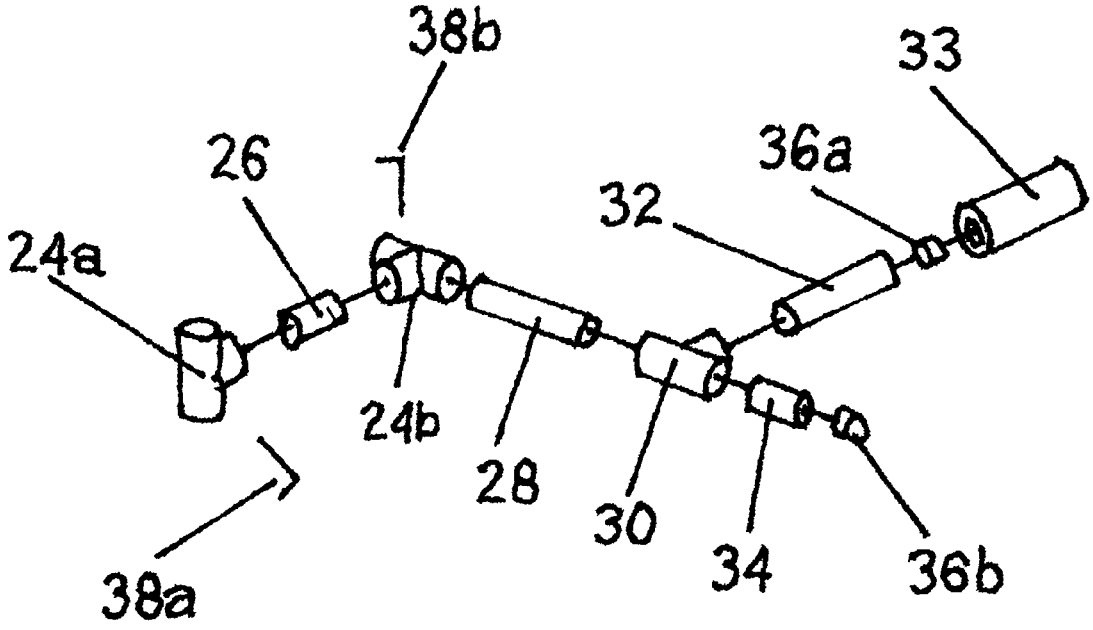
FIG. 3 shows a knee brace
Figure 6:
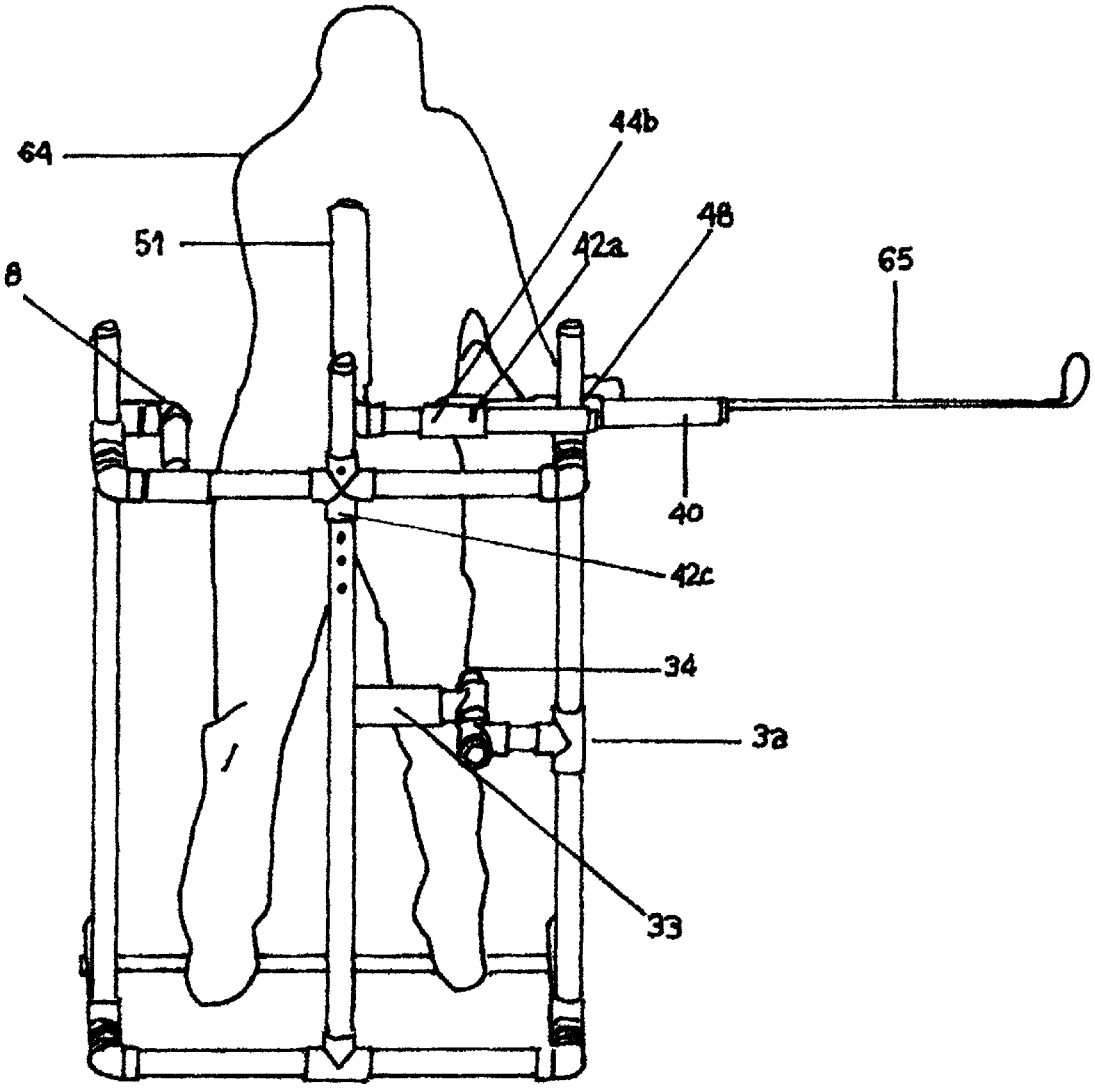
FIG. 6 shows a back view with golfer

Turning now to FIG. 3, there is shown in exploded view of said 3*a*. Comprised of a knee brace adjustable T joint 24*a*, attached to predetermined knee brace straight pipe 26 and joined with knee brace adjustable T joint 24*b*. Said 24*a* is attached to mast with knee brace securing pin 38*a* at knee height as shown as in FIG. 5. Knee brace telescoping post 28 is attached to said 24*b* with knee brace securing pin 38*b* as shown in FIG. 3. Opposite side said 28 is knee brace T joint 30, connected to said 30 is knee brace horizontal bar 32, slidably attached with knee brace horizontal bar foam pad 33, covering said 32. Opposite side of said 30 is knee brace lateral bar 34. Inserted into open ends of said 32 and said 34 are knee brace plastic end caps 36*a*, 36*b*. Said 3*a* as shown in FIG. 5 and FIG. 6, illustrates the position of said 34, restricting lateral movement of the knee. Said 3*a* as shown in FIG. 5 and FIG. 6, illustrates said 33 positioned behind the knee to form the proper angle for setup position, also controlling vertical movement.

Figure 4:
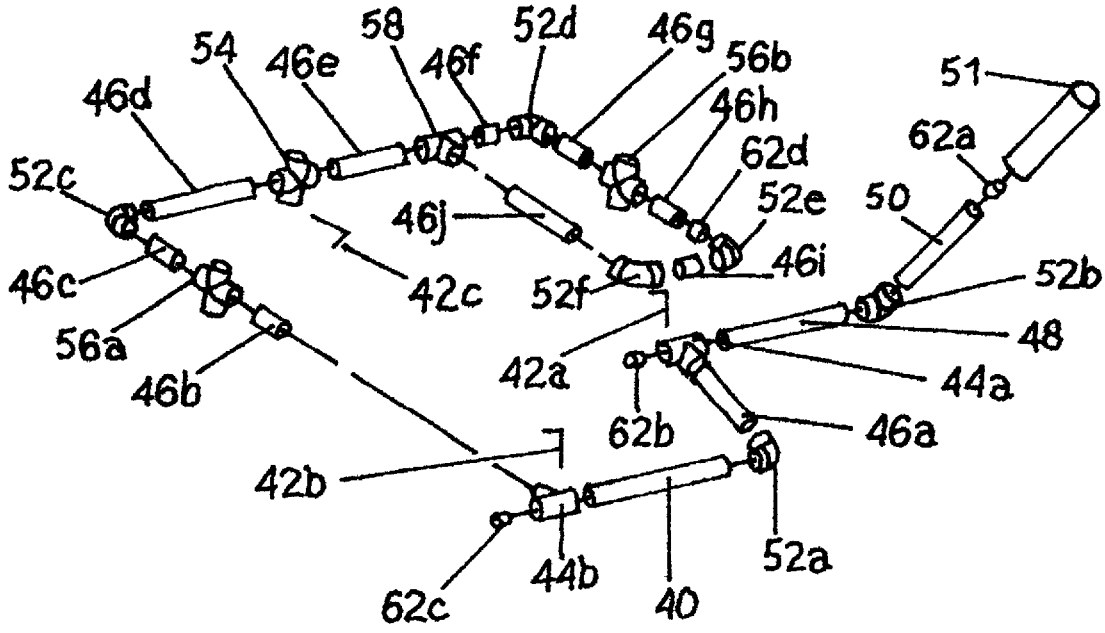
FIG. 4 shows an upper support assembly

Turning now to FIG. 4, there it is shown a detailed top view, of said 4*a*. Comprised of a telescoping lateral bar 40, attached to angled side bar 7, as shown in FIG. 5. Attached to said 40 is top 90 degree fitting 52*a*, opposite side of said 52*a*, is predetermined angled top straight pipe 46*a*, connected to other end of said 46*a* is top adjustable T fitting 44*a*. Telescoping back bar 48, is slidably inserted through said 44*a* and secured with top securing pin 42*a*. Opposite side of said 48 is connected to top 90 degree fitting 52*b*. Opposite side of said fitting 52*b* is attached an angled vertical axis bar 50, slidably attached to said 50 is vertical axis bar foam pad 51. Attached to open ends of said 50, 48, 40 are top end caps 62*a*, 62*b* and 62*c*. Said 40 is slidably inserted through top adjustable T fitting 44*b* and secured with top securing pin 42*b*. Said 44*b*, is connected to predetermined top straight pipe 46*b*. Said 46*b* is connected to sliding 4 way fitting 56*a*, opposite side of said 56*a* is predetermined top straight pipe 46*c*. Connected to opposite end of said pipe 46*c* is top 90 degree fitting 52*c*. Said fitting 52*c* is attached to predetermined top straight pipe 46*d*. Said 46*d* is connected to adjustable 4 way fitting 54. Said 54 is secured to mast 22*b* with top securing pin 42*c* as shown in FIG. 4 and FIG. 5. Opposite side of said 54 is predetermined top straight pipe 46*e*. Attached to opposite side of said 46*e* is T fitting 58. Attached to said 58 is predetermined top straight pipe 46*f*, attached to top 90 degree fitting 52*d*. Opposite side of said 52*d* is attached measured top straight pipe 46*g*, connected to sliding 4 way fitting 56*b*. Said 56*b* is attached to top measured straight pipe 46*h*, inserted in the open end of said 46*h* is top end cap 62*d*. Attached to said 46*h* is detachable spacer bar 8, as shown in FIG. 1, comprised of, top 90 degree fitting 52*e*, connected to predetermined top measured straight pipe 46*i*. Opposite side of said pipe 46*i* is top 90 degree fitting 52*f*, attached to predetermined top straight pipe 46*j*. Said 8 can be detached from said 4*a* to allow more room for hip rotation.

As shown in FIG. 6, said 40, is adjustable to said 64 approximate waist size, leaving room for rotation of hips. Extruding section of said 40 as shown by position of golf club 65 in FIG. 6, is used for reference of swing position. Also shown is FIG. 5, FIG. 6, said 51 is adjusted to center of said 64 spine, to form the angle of back at setup position and promote rotation of upper body around the axis of spine.

Operation of Invention

The manner of using the golf-training device, is to make adjustments to individual size. This is done by standing in device and sliding upper support assembly 4*a* up or down vertical mast 22*a*, 22*b* and 22*c*. Adjust telescoping back bar 48 to rest on lower back, just above buttocks as in FIG. 5. Attach securing pin 42*c* to sliding 4 way joint 54 to mast 22*b* at determined point as in FIG. 5 and FIG. 6. This sets the height of said 4*a* and positions angled side bar 7 from lower back to the hip as in FIG. 5, controlling lateral and vertical movement.

Adjust telescoping lateral bar 40 to position hips in the center of device, leave space for rotation of hips on side of detachable spacer bar 8 as in FIG. 6. Attach securing pin 42*b* to sliding T joint 44*b* at determined position as in FIG. 5. Detachable spacer bar 8 may be detached if needed to allow more space for rotation of hips as in FIG. 4. Extruding section of lateral bar 40 is used as a guide for swing position as shown in FIG. 6.

Position the padded vertical axis bar 51 in center of back. Adjust telescoping back bar 48 in or out as in FIG. 6, attach securing pin 42*a* to determined position. Said 51 positions back to proper spine angle thru out swing, and allows golfer to rotate around said 51 as axis of spine.

Stand erect in device, top end cap 62*a*, as shown in FIG. 5, of said 51 will be touching center of back. Knee brace horizontal bar foam pad 33 at erect standing position is touching back of knee, knee brace lateral bar 34 is touching side of knee as shown in FIG. 5 and FIG. 6. Adjust to these positions by sliding adjustable T joint 24*a*, up or down vertical mast, to determined height of knee and attach with securing pin 38*a* as shown in FIG. 5.

Slide knee brace telescoping post 28 in or out thru sliding adjustable T joint 24*b*, contact back of knee with said 33, attach securing pin 38*b* to determined position as shown in FIG. 5. Knee brace lateral bar 34, contacting outside knee, controls lateral movement of knee, while said 33 maintains proper angle of knee during swing, restricting the movement of knee to a set position, controlling vertical movement.

Standing erect, end cap 62*a* of said 51 in center of back, knee brace 3*a* touching back and side of knee, move buttocks out, to contact said 48, at lower back as in FIG. 5. Said 51 and said 3*a* from bent over position will form golfers individual angles of stance as in FIG. 5. In stance position in device, toes of feet only, should be on toeboard 9, for balance on balls of feet and stability of device as in FIG. 5. Said strip 9 aligns the feet parallel to target line, provides a straight line to guides hands up to extruding section of said 40, at the point shoulders will rotate and wrist cock.

Adjust said 9 to position toes of feet on said 9 by unbolting bolt and wing-nut 10*a*, 10*b*. Move said 9 in or out on base adjustable toeboard post 12*a*, 12*b* to desired position and refasten, as in FIG. 2

Conclusion, Ramifications and Scope

Thus the reader will see that the golf setup and movement device of invention is highly effective in producing proper stance and controlling movement. Reader will see the versatility of device and ease of use. Furthermore the golf setup and movement device has additional advantages in that allows flexibility, so golfer can move smoothly provides weather resistant materials allows easy dismantling for storage or transport While my above description contains many specifities, these should not be construed as limititations on the scope of the invention, but rather as an exemplification of one preferred embodiment there of. Many other variations are possible. For example toeboard strip, bottom section, masts, knee brace and upper support assembly elements can be eliminated, changed in size, shape, color, or material, attached to adjacent elements in a different manner or made integrally, or separately.

I claim:

1. A golf set-up training device for positioning and controlling the movements of the human body composed of:

a) a base;

b) an adjustable supper support assembly mounted on said base and having slidably mounted telescoping members, which abuts a torso during a golf swing;

c) a plurality of vertical masts of equal length, with a plurality of adjustment holes in said masts;

d) a knee brace slidabley mounted, having telescoping members to abut the side and back of a knee of said torso;

e) a vertical axis bar with means for mounting said vertical axis bar so as to abut the center of said torso's back as an axis of spine;

f) a horizontal back bar having a plurality of positions with slidabley mounted means mounted thereon;

whereby said horizontal back bar abuts horizontally across a lower lumbar of the back of said torso.

2. The device of claims 1 further comprising an angled side bar, means for said bar to abut the side of body from lower lumbar of back, to hip.

3. The device of claim 2 further comprising a lateral bar slidably mounted whereby golfer has plurality of positions to center body in device.

4. The device of claim 3 further comprising a knee brace slidably mounted, means for plurality of positions on vertical mast, such that said brace is at height of knee.

5. The device of claim 4 further comprising said brace is adjustable in or out, slidably mounted, with plurality of positions, so that it can abut the back and side of knee.

6. The device of claim 5 further comprising, a U shaped base, means for receiving said masts, supporting said device.

7. The device of claim 6 further comprising a toeboard, means for plurality of positions whereby golfer places toes on said to stabilize device and promote balance on balls of feet.

* * * * *